US009988922B2

(12) United States Patent
Friis

(10) Patent No.: US 9,988,922 B2
(45) Date of Patent: Jun. 5, 2018

(54) IMPINGEMENT BAFFLE FOR A GAS TURBINE ENGINE AND GAS TURBINE ENGINE

(75) Inventor: Johan Friis, Svärtinge (SE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1640 days.

(21) Appl. No.: 12/883,260

(22) Filed: Sep. 16, 2010

(65) Prior Publication Data

US 2011/0064567 A1 Mar. 17, 2011

(30) Foreign Application Priority Data

Sep. 17, 2009 (EP) ..... 09011894

(51) Int. Cl.
*F01D 25/12* (2006.01)
*F01D 11/08* (2006.01)

(52) U.S. Cl.
CPC ..... *F01D 11/08* (2013.01); *F01D 25/12* (2013.01); *F05D 2230/13* (2013.01); *F05D 2260/201* (2013.01)

(58) Field of Classification Search
USPC ..... 415/134, 136, 138, 139, 170.1, 173.1, 415/176, 196; 403/289, 321, 326, 333, 403/335, 339, 340, 354, 364
See application file for complete search history.

(56) References Cited

U.S. PATENT DOCUMENTS

| | | | | |
|---|---|---|---|---|
| 4,303,371 | A * | 12/1981 | Eckert | 415/116 |
| 4,337,016 | A | 6/1982 | Chaplin | |
| 5,078,535 | A * | 1/1992 | Kirkpatrick | 403/339 |
| 5,593,278 | A | 1/1997 | Jourdain et al. | |
| 8,231,338 | B2 * | 7/2012 | Ballard et al. | 415/136 |
| 2005/0241314 | A1 | 11/2005 | Takaya et al. | |
| 2006/0110216 | A1 * | 5/2006 | Yu | 403/340 |

FOREIGN PATENT DOCUMENTS

| | | |
|---|---|---|
| EP | 0 266 235 A1 | 5/1988 |
| EP | 0 940 562 A2 | 9/1999 |

* cited by examiner

*Primary Examiner* — Richard Edgar
*Assistant Examiner* — Michael Sehn

(57) ABSTRACT

An impingement baffle for a gas turbine engine is provided. The impingement baffle is a one piece impingement ring with one opening and with fastening elements at both free ends of the impingement ring to enable the closing of the impingement ring. A gas turbine engine including at least one such an impingement baffle is also provided.

17 Claims, 2 Drawing Sheets

IMPINGEMENT BAFFLE FOR A GAS TURBINE ENGINE AND GAS TURBINE ENGINE

CROSS REFERENCE TO RELATED APPLICATIONS

This application claims priority of European Patent Office application No. 09011894.4 EP filed Sep. 17, 2009, which is incorporated by reference herein in its entirety.

FIELD OF INVENTION

The present invention relates to an impingement baffle for a gas turbine engine. The invention relates further to a gas turbine engine comprising at least one impingement baffle.

BACKGROUND OF INVENTION

Gas turbine engines are made to operate more efficiently by increasing the turbine operating temperatures to very high levels. Since the preferred temperatures are well above the temperatures allowable for use with current flow path metals, it is necessary to provide cooling of these parts in order that they may exhibit acceptable life characteristics. The turbine blades which operate in the main gas flow stream can be cooled among others by way of impingement cooling. The tip seal which surrounds the row of turbine blades forming a stationary outer flow path is usually cooled by way of impinging a supply of cooling air to flow directly on the outer surface of the tip seal element. Traditionally, impingement of air against the outer surface of the tip seal is accomplished by way of an impingement baffle which is mounted to the outer surface of the tip seal structure.

It is an aim of gas turbine engines to have a high efficiency and among other things a long tip seal life. Therefore, it is desired to provide an efficient cooling of turbine tip seal segments. To obtain good cooling the impingement baffle, comprising normally an impingement plate or an impingement ring, should not crack and should not wear. Therefore, the arrangement of an impingement plate or an impingement ring is very important. For example, wear may be caused by impingement rings which are inadequately fastened or which are translated circumferentially during operation in a cavity between tip seals and a carrier ring. High stresses in impingement plates or rings can cause cracks.

It is known to use separate impingement plates which are usually brazed together. Further, impingement rings are known which are made of more than one part. The fixing of separate impingement plates or of parts of an impingement ring is difficult, complex and cost-intensive because of the time required for fixing. Furthermore, continuous impingement rings are known. Continuous impingement rings or closed impingement rings, respectively, have the disadvantage that they can cause high stresses and therefore the continuous impingement rings have a high cracking risk.

The impingement plates and impingement rings should be arranged to avoid wear of mating surface on tip seals. Therefore, impingement plates or impingement rings are advantageously arranged tangential to the tip seal elements.

SUMMARY OF INVENTION

In view of the problems of the known impingement baffles, it is an object of the invention to provide an easy and cheap impingement baffle, for gas turbine engines, that can resist high stresses and minimize leakages. Further a gas turbine engine is desired which can provide an efficient cooling of turbine tip seal segments and which has an increased gas turbine efficiency and a long tip seal life.

The problems of the invention are solved by an impingement baffle with the features according to the claims and by a gas turbine engine with the features according to the claims. Advantages, features, details, aspects and effects of the invention arise from the dependent claims, the description and the figure. Features and details which are described in connection with the impingement baffle count as well for the gas turbine engine, and vice versa.

According to a first aspect of the present invention the problem is solved by an impingement baffle for a gas turbine engine, whereby the impingement baffle is a one-piece impingement ring with one opening and with at least one fastening element at both free ends of the impingement ring to enable the closing of the impingement ring.

In other words, the problem is solved by an impingement baffle for a gas turbine engine, whereby the impingement baffle is a one-piece impingement ring and the impingement ring is a one-piece split ring split at a single location, the impingement ring having at least one fastening element at both free ends to enable the closing of the impingement ring.

Because the impingement ring is a one-piece impingement ring with fastening elements at both free ends of the impingement ring, it is easy to fix the fastening elements of both free ends to each other to close the impingement ring. The impingement ring can have two conditions: a non-closed condition and a closed condition. In the non-closed condition, the impingement ring can be arranged easily at the appropriate gas turbine element, for example at a tip seal support element of the gas turbine engine. The mating fastening elements of both free ends can be pulled apart during the assembly of the impingement ring. After the location of the impingement ring at the appropriate gas turbine element, the impingement ring can be closed, so that the impingement ring is fixed at the appropriate gas turbine element. Advantageously the impingement ring is arranged tangentially to the appropriate gas turbine element, where the impingement ring fulfills its function, in particular an effective cooling of turbine tip seal elements and/or sealing to minimize leakages.

The fastening elements at both free ends of the impingement ring are built in such a way that they can be fixed to each other in an easy assembly operation. In the closed condition the fastening elements are in sealed contact with each other.

Such an impingement ring can minimize the risk of crackings and can avoid the high stresses can occur in the impingement ring. Another advantage of such an impingement ring is that the impingement ring can be manufactured simply and cheaply. Further, the impingement ring can be assembled easily and fast at the appropriate gas turbine element because of the possibility to pull apart the mating fastening elements of the impingement ring. The impingement ring can also minimize leakages easily because there is only one small fastening area at the free ends of the impingement ring and the rest of the ring is continuous.

According to an advantageous development of the invention the impingement ring is elastic, in particular spring-elastic. In the non-closed condition the impingement ring can be bent up or be pulled apart, respectively. Thus the impingement ring can be assembled at the appropriate gas turbine element easily and quickly in the non-closed condition. When the desired position at the appropriate gas turbine element is achieved the impingement ring can be closed. After the closing the impingement ring is fixed at the appropriate gas turbine element.

The fastening elements at both free ends of the impingement ring are advantageously complementary to each other. The fastening elements at both free ends are mating elements. The fastening element of the first free end fits exactly in the fastening element of the second free end, whereby the shape of the fastening elements can vary. Preferred are fastening elements which are arranged aligned to the free ends of the impingement ring. That means the fastening elements are preferably an elongation of the main body of the impingement ring.

In a preferred embodiment of the impingement baffle a first fastening element comprises a male connection flap and a second fastening element comprises a female connection flap. The male connection flap and the female connection flap can mate with each other, namely in the way that the impingement ring stays closed after assembling the male connection flap and the female connection flap together. The male connection flap intertwines form-closed with the female connection flap. The male connection flap can be part of a fastening element at the first free end of the impingement ring and the female connection flap can be part of a fastening element at the second free end of the impingement ring. It is also possible that at each free end at least a male and at least a female connection flap are arranged.

Advantageously there is a smooth transition at the inner lateral area of the impingement ring. Additionally there is a smooth transition at the outer lateral area of the impingement ring. Hereby the steam flow or cooling air flow is not influenced very much by the impingement ring, thus no turbulences are created during operation.

According to a further advantageous development of the invention an impingement baffle is provided, whereby the fastening elements comprise an additional locking device for assembling the fastening elements of both free ends to each other. The fastening elements, in particular the male connection flap and the female connection flap, can have an additional locking device for a better fixation of the fastening elements to each other. Preferred is an additional locking device with a hook at a fastening element at the first free end of the impingement ring, for example at the male connection flap at the first free end, and a recess for engaging the hook at a fastening element at the second free end of the impingement ring, for example at the female connection flap of the second free end. The impingement ring or the fastening elements of the impingement ring can be assembled in the same way as a belt, joining the fastening elements, in particular the connection flaps, together.

According to a further advantageous development of the invention an impingement baffle is provided, whereby each fastening element comprises two or more elongated beams, which are arranged parallel and displaced to each other at one free end of the impingement ring. In a preferred embodiment of the impingement baffle both of the free ends of the impingement ring comprise two elongated beams. Each beam arises from the main body of the impingement ring. Between the two or more beams at one free end of the impingement ring a gap is provided. The two or more beams of the first free end of the impingement ring can be slid on, in particular form-shaped, the two or more beams of the second free end of the impingement ring. The beams at the free ends of the impingement ring and the main body of the impingement ring are advantageously made of one piece. Preferred are the beams and the main body of the impingement ring being monolithic construction.

In a further preferred embodiment of the impingement baffle, the male connection flap is located at the free end of at least one elongated beam of a fastening element and the female connection flap is located in the area, where an elongated beam arises from the main body of the impingement ring. The arrangement of the male connection flap and the female connection flap in this way allows an easy assembling of the connection flaps together.

According to a further advantageous development of the invention an impingement baffle is provided, whereby the impingement ring comprises several holes. This allows high pressure air to pass through the holes of the impingement ring. Advantageously the impingement ring is perforated with holes.

The impingement ring, in particular the fastening elements of the impingement ring, advantageously has been laser manufactured. Cost effectiveness can be gained through a design possible to laser cut in one operation. The flaps can be pressed into the impingement ring or the beams at the free ends of the impingement ring and the impingement ring can be rolled to get its final shape.

Such an impingement baffle, as described before, can provide an efficient cooling of gas turbine tip seal segments and thus can increase the turbine efficiency and the tip seal life. Furthermore, using such an impingement baffle enables cooling of turbine tip seal segments in a cost-efficient, east-to-manufacture and assembly-friendly way. The impingement ring can be easily located tangential to the appropriate gas turbine element avoiding wear on mating surface on tip seals.

According to a second aspect of the invention the object is solved by a gas turbine engine comprising at least one impingement baffle whereby the impingement baffle is constructed like an impingement baffle according to the first aspect of the invention.

A gas turbine engine having such an impingement baffle, as described before, can provide an efficient cooling of gas turbine tip seal segments. The efficiency of the gas turbine efficiency can be increased as well as the tip seal life. Further using such an impingement baffle in a gas turbine engine enables cooling of turbine tip seal segments in cost-efficient, easy-to-manufacture and assembly-friendly way.

BRIEF DESCRIPTION OF THE DRAWINGS

The invention will now be described again in detail with reference to the enclosed figure, wherein.

Elements with the same function and mode of operation are provided in the FIG. 1 to 4 with the same reference signs.

DETAILED DESCRIPTION OF INVENTION

Figure 1:
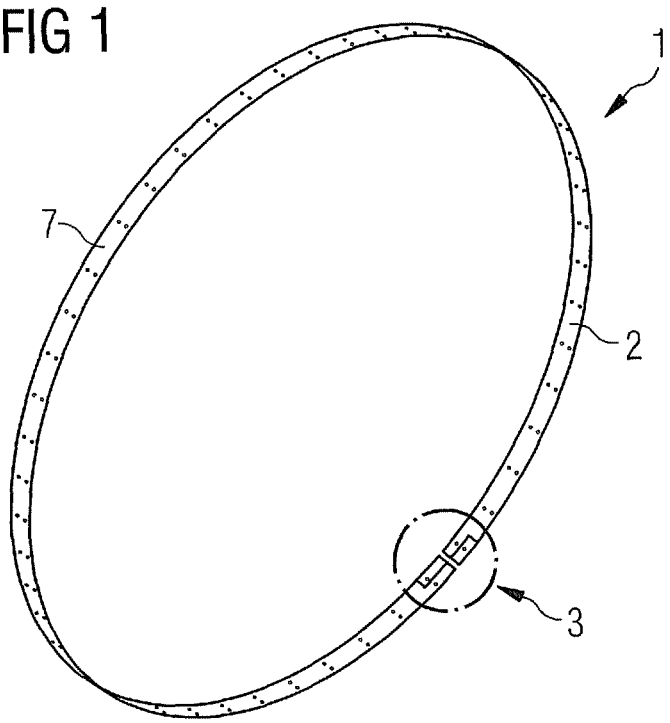
FIG. 1 shows schematically a perspective view of one embodiment of an impingement ring constructed according to the invention.

FIG. 1 shows schematically a perspective view of one possible embodiment of an impingement baffle 1, which is an impingement ring 2, constructed according to the invention. The impingement ring 2 has a one-piece main body 7 and a single opening 3.

Figure 2:
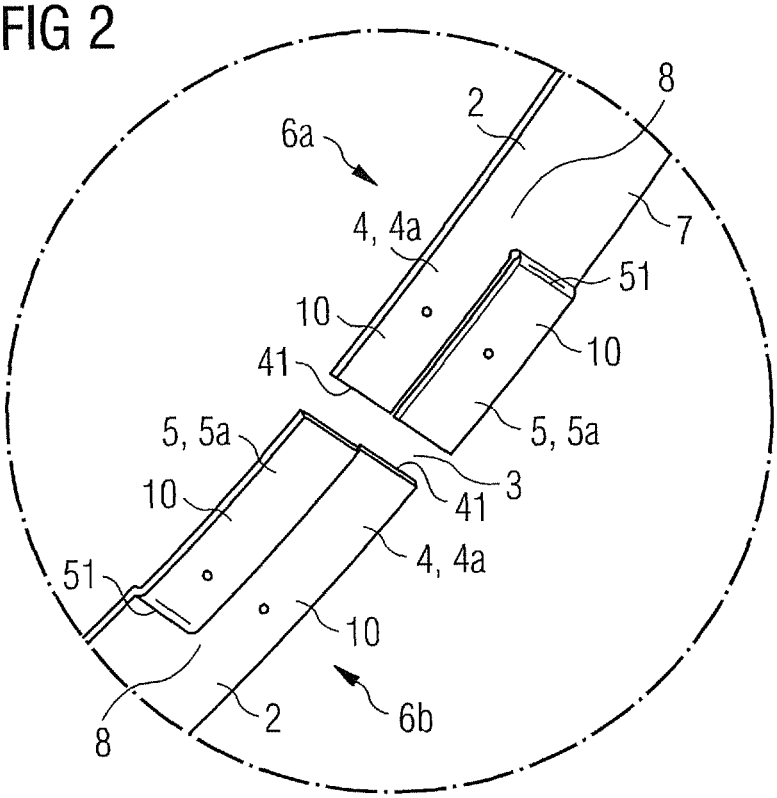
FIG. 2 shows schematically a perspective view of an enlarged cut-out of the free ends and the fastening elements of the impingement ring according to FIG. 1.

FIG. 2 shows schematically a perspective view of an enlarged cut-out of the free ends 6*a*, 6*b* and the fastening elements 4, 5 of the impingement ring 2 according to FIG. 1. The impingement ring 2 has one opening 3. The free ends 6*a*, 6*b* of the impingement ring 2 are opposed to each other. At each of the free ends 6*a*, 6*b* two fastening element 4, 5 are arranged. The fastening elements 4, 5 of the first free end 6*a* and the fastening elements 4, 5 of the second free end 6*b* are mating elements. The fastening elements 4, 5 at the first free end 6*a* fit to the fastening elements 4, 5 at the second free end 6*b* of the impingement ring 2. Advantageously the fastening elements 4, 5 at the first free end 6*a* can be slit on the fastening elements 4, 5 at the second free end 6*b* of the impingement ring 2. Each fastening element 4, 5 comprise a beam 10 which is arranged at the main body 7 of the impingement ring 2.

Advantageously, the fastening elements 4, 5 are arranged aligned to the free ends 6*a*, 6*b* of the impingement ring 2. That means the fastening elements 4, 5 are in this embodiment of the impingement baffle 1 an elongation of the main body 7 of the impingement ring 2.

A first fastening element 4 of each free end 6*a*, 6*b* comprises a male connection flap 41 and a second fastening element 5 of each free end 6*a*, 6*b* comprises a female connection flap 51. The male connection flaps 41 and the female connection flaps 51 can mate with each other, namely in the way that the impingement ring stays closed after assembling the male connection flaps 41 and the female connection flaps 51 together. The male connection flaps 41 intertwine form-closed with the female connection flaps 51.

Once closed, the impingement ring 2 may result in a cylindrical inner surface without any elevations. The outer surface may be cylindrical with an elevation radially outwards where the free ends 6*a*, 6*b* mate.

In this embodiment of the impingement baffle 1 there is a smooth transition at the inner lateral area and a smooth transition at the outer lateral area of the impingement ring 2.

The impingement ring 2 or the fastening elements 4, 5 of the both free ends 6*a*, 6*b* of the impingement ring 2 can be assembled in the same way as a belt, joining the fastening elements 4, 5, in particular the connection flaps 41, 51, together.

Each fastening element 4, 5 comprise an elongated beam 10. The beams 10 at one free end 6*a*, 6*b* are arranged parallel and displaced to each other. In this preferred embodiment of the impingement baffle 1 both of the free ends 6*a*, 6*b* of the impingement ring 2 comprise two elongated beams 10. Each beam 10 arises from the main body 7 of the impingement ring 2. One of the beams 10 may be elevated in respect to the main body 7 of the impingement ring 2 or in respect another beam 10 at one free end 6*a*, 6*b*. The beam 10 may be substantially parallel to the main body 7. Between two beams 10 at one free end 6*a*, 6*b* of the impingement ring 2 a gap or an elongated slot is formed. The two beams 10 of the first free end 6*a* of the impingement ring 2 can be slid on, in particular form-shaped, the two beams 10 of the second free end 6*b* of the impingement ring 2. The beams 10 at the free ends 6*a*, 6*b* and the main body 7 of the impingement ring 2 are made of one piece. Advantageously the beams 10 and the main body 7 of the impingement ring 2 are being monolithic construction.

The male connection flaps 41 are located at the free ends of the elongated beams 10 and the female connection flaps 51 are located in the areas 8, where an elongated beam 10 arises from the main body 7 of the impingement ring 2. The arrangement of the male connection flaps 41 and the female connection flaps 51 in this way allows an easy assembling of the connection flaps 41, 51 together.

Figure 3:
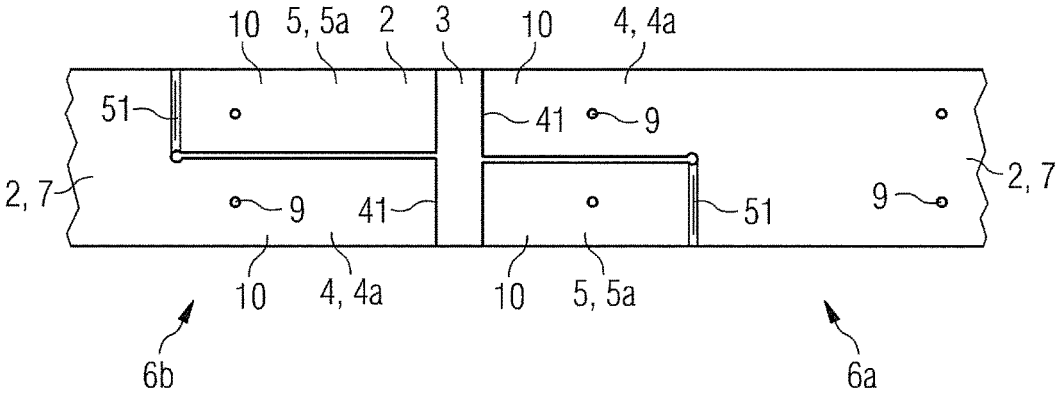
FIG. 3 shows schematically a side view of the free ends and the fastening elements of the impingement ring according to FIG. 1.

In FIG. 3, a schematic side view of the free ends 6*a*, 6*b* and the fastening elements 4, 5 of the impingement ring 2 according to FIG. 1 are shown. The impingement ring 2 has a plurality of holes 9 for allowing high pressure cooling air to pass through the body of impingement ring 2. Advantageously the impingement ring 2 is perforated with a plurality of holes 9. If not fastened, there is an opening 3 between the two free ends 6*a*, 6*b*. FIG. 3 shows the impingement ring 2 in a non-closed condition. Both free ends 6*a*, 6*b* have two fastening elements 4, 5. Each fastening element 4, 5 comprises an elongated beam 10. The elongated beams 10 at one free end 6*a*, 6*b* are arranged parallel and displaced to each other. Because of the specific complementary arrangement of the elongated beams 10 at the both free ends 6*a*, 6*b* the fastening elements 4, 5 of the first free end 6*a* can slide on the fastening elements 4, 5 of the second free end 6*b*.

Figure 4:
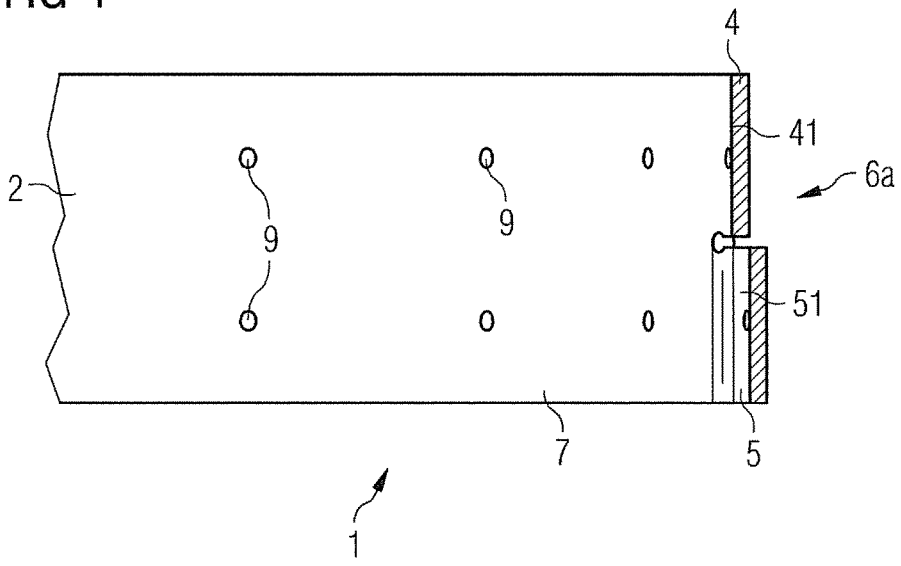
FIG. 4 shows schematically a cross-sectional view of one free end of the impingement ring according to FIG. 1.

FIG. 4 shows schematically a cross section view of the first free end 6*a* of the impingement ring 2 according to FIG. 1. In the figure, the ring bends from left to right turning into the direction out of the drawing. A first fastening element 4 is directed substantially in the direction of the viewer. The impingement ring 2 is perforated with holes 9. The first fastening element 4 comprises a male connection flap 41 and a second fastening element 5 comprises a female connection flap 51. The connection flaps 41, 51 of this first free end 6*a* can overlap—once the impingement ring 2 is closed—with complementary connection flaps 41, 51 of a second free end 6*b*, which is not shown in this figure.

The connection flaps 41, 51 provide an easy assembly operation and at the same time minimizing leakage as the connection flaps 41, 51 of both free ends 6*a*, 6*b* are in contact with each other. The impingement ring can be assembled in the same way as a belt, joining the connection flaps 41, 51 together.

Cost effectiveness is gained through a design possible to laser cut in one operation and press the connection flaps 41, 51 and roll the ring shape.

The invention claimed is:

1. An impingement baffle for a gas turbine engine, comprising:

a fastening element at both of two free ends, wherein the impingement baffle is a one piece impingement ring, the one piece impingement ring being a split ring that is split at a single location, and wherein the fastening element enables the closing of the impingement ring, wherein a first fastening element comprises a male connection flap and a second fastening element comprises a female connection flap, and wherein the male connection flap and the female connection flap are arranged at a first free end of the impingement ring and overlap with complementary connection flaps arranged at a second free end of the impingement ring.

2. The impingement baffle as claimed in claim 1, wherein the impingement ring is elastic.

3. The impingement baffle as claimed in claim 2, wherein the impingement ring is spring-elastic.

4. The impingement baffle as claimed in claim 1, wherein the fastening elements comprise a locking device for assembling the fastening elements of both of two free ends to each other.

5. The impingement baffle as claimed in claim 4, wherein the locking device is a hook at a first fastening element at a first free end and a recess for engaging the hook at a second fastening element at a second free end.

6. The impingement baffle as claimed in claim 1, wherein each fastening element comprises an elongated beam whereby the elongated beam of each free end is arranged parallel and displaced to each other.

7. The impingement baffle as claimed in claim 6, wherein the male connection flap is located at a first free end of the elongated beam of the first fastening element, and wherein the female connection flap is located in an area where the elongated beam arises from a main body of the impingement ring.

8. The impingement baffle as claimed in claim 6, wherein the elongated beam of the first fastening element of the first free end may be slid on the elongated beam of the second fastening element of the second free end.

9. The impingement baffle as claimed in claim 1, wherein the impingement ring comprises a plurality of holes.

10. The impingement baffle as claimed in claim 1, wherein impingement ring is laser manufactured, and wherein the fastening elements of the impingement ring are laser manufactured.

11. The impingement baffle as claimed in claim 1, wherein fastening elements are each aligned along the respective free ends of the impingement ring such that once the impingement ring is closed it has a cylindrical inner surface without any elevation.

12. The impingement baffle as claimed in claim 1, wherein at each free end of the impingement ring at least a male and at least a female connection flaps are arranged.

13. The impingement baffle for a gas turbine engine as claimed in claim 1 wherein the fastening element of the first free end can slide on the fastening element of the second free end.

14. A gas turbine engine, comprising:

an impingement baffle, comprising:

a fastening element at both of two free ends, wherein the impingement baffle is a one piece impingement ring, the one piece impingement ring being a split ring that is split at a single location, and wherein the fastening element enables the closing of the impingement ring, wherein a first fastening element comprises a male connection flap and a second fastening element comprises a female connection flap, and wherein the male connection flap and the female connection flap are arranged at a first free end of the impingement ring and overlap with complementary connection flaps arranged at a second free end of the impingement ring.

15. The gas turbine as claimed in claim 14, wherein the impingement ring is elastic.

16. The gas turbine as claimed in claim 15, wherein the impingement ring is spring-elastic.

17. The gas turbine engine as claimed in claim 14 wherein the fastening element of the first free end can slide on the fastening element of the second free end.

* * * * *